US007637059B2

(12) United States Patent
Chang et al.

(10) Patent No.: US 7,637,059 B2
(45) Date of Patent: Dec. 29, 2009

(54) ROLLER ASSEMBLY FOR A FRAMELESS SLIDING GLASS DOOR

(75) Inventors: James Chang, Taichung (TW); Chih-Lun Hsieh, Taichung (TW)

(73) Assignee: Door & Window Hardware Co. (TW)

( * ) Notice: Subject to any disclaimer, the term of this patent is extended or adjusted under 35 U.S.C. 154(b) by 225 days.

(21) Appl. No.: 11/819,563

(22) Filed: Jun. 28, 2007

(65) Prior Publication Data

US 2009/0000204 A1 Jan. 1, 2009

(51) Int. Cl.
*E05D 13/00* (2006.01)

(52) U.S. Cl. ..... 49/425; 49/409; 16/91; 16/102; 16/105

(58) Field of Classification Search ..... 49/409, 49/425; 16/91, 102, 105, 106, 107; 4/556, 4/557

See application file for complete search history.

(56) References Cited

U.S. PATENT DOCUMENTS

| | | | | | |
|---|---|---|---|---|---|
| 862,561 | A * | 8/1907 | Hunt | 16/105 |
| 1,017,757 | A * | 2/1912 | Hoffman | 16/105 |
| 2,079,028 | A * | 5/1937 | Nemec | 16/105 |
| 2,145,403 | A * | 1/1939 | Nemec | 49/225 |
| 2,680,875 | A * | 6/1954 | Coffey | 16/105 |
| 3,058,173 | A * | 10/1962 | Brydolf | 49/411 |
| 3,148,405 | A * | 9/1964 | Dickinson et al. | 16/105 |
| 3,261,129 | A * | 7/1966 | Brydolf et al. | 49/411 |
| 3,555,612 | A * | 1/1971 | Procton | 16/105 |
| 4,099,599 | A * | 7/1978 | Randall | 187/313 |
| 4,288,887 | A * | 9/1981 | Johnson et al. | 16/105 |
| 4,391,019 | A * | 7/1983 | Downes | 16/105 |
| 5,070,575 | A * | 12/1991 | Redman et al. | 16/96 R |
| 6,381,904 | B1 * | 5/2002 | Tedescucci | 49/409 |
| 6,865,848 | B2 * | 3/2005 | Krimmel | 49/409 |
| 7,065,831 | B2 * | 6/2006 | Elmer | 16/91 |
| 7,137,172 | B2 * | 11/2006 | Elmer | 16/105 |

FOREIGN PATENT DOCUMENTS

WO WO 9413915 A1 * 6/1994

* cited by examiner

*Primary Examiner*—Jerry Redman
(74) *Attorney, Agent, or Firm*—Hershkovitz & Associates, LLC; Abraham Hershkovitz

(57) ABSTRACT

A roller assembly for a frameless sliding glass door has a bracket, a roller and at least one fastening device. The bracket is attached to the frameless sliding glass door and a track and has at least one elongated hole, an adjustment hole and a set screw. The at least one elongated hole is formed through the bracket near the lower end. The adjustment hole is formed through the lower edge of the bracket and communicates with the elongated hole in the lower end of the bracket. The set screw is threaded and corresponds with the adjustment hole. The roller is rotatable connected to the rear surface of the bracket in the upper end and mounted on the track. The fastening device is connected to the bracket and the frameless sliding glass door through the elongated hole and the corresponding through hole.

2 Claims, 4 Drawing Sheets

ROLLER ASSEMBLY FOR A FRAMELESS SLIDING GLASS DOOR

BACKGROUND OF THE INVENTION

1. Field of the Invention

The present invention relates to a roller assembly, and more particularly relates to a roller assembly that allows a frameless sliding glass door to be set to parallel to the ground easily and adjust a crack between the frameless sliding glass door and the ground.

2. Description of Related Art

A frameless sliding glass door has a top, two conventional roller assemblies and a track. The conventional roller assemblies are connected to a top of the frameless sliding glass door with multiple through holes to slidably mount the frameless sliding glass door on the track. Each conventional roller assembly has a bracket, a roller and multiple fastening devices.

The bracket has a rear surface, an upper end, a lower end and multiple mounting holes. The mounting holes are formed through the bracket near the lower end and correspond to the through holes in the frameless sliding glass door.

The roller is rotatably mounted on the rear surface of the bracket at the upper end and is slidably mounted on the track.

The fastening devices are mounted in the mounting holes and the corresponding through holes to hold the frameless sliding glass door on the bracket. Therefore, the frameless sliding glass door is slidably mounted on the track with the conventional roller assembly.

However, the mounting holes in the brackets are circular holes and a person cannot adjust the position between the conventional roller assemblies and the frameless sliding glass door. When the track is mounted at an undesired angle on a wall, such as slanting or at an angle from the horizon, a bottom of the frameless sliding glass door will not be parallel to the ground and this may cause the bottom of the frameless sliding glass door to make contact with the ground. Furthermore, the mounting holes of the brackets of the conventional roller assemblies may not parallel to each other, and this also influence the accuracy of mounting the frameless sliding glass door on the track.

The roller assembly for a frameless sliding glass door in accordance with the present invention mitigates or obviates the aforementioned problems.

SUMMARY OF THE INVENTION

The main objective of the present invention is to provide a roller assembly that can allows a frameless sliding glass door to be easily set parallel to the ground.

The roller assembly for a frameless sliding glass door has a bracket, a roller and at least one fastening device. The bracket is attached to the frameless sliding glass door and a track and has a rear surface, an upper end, a lower end, a lower edge, at least one elongated hole, an adjustment hole and a set screw. The at least one elongated hole is formed through the bracket near the lower end. The adjustment hole is formed through the lower edge of the bracket and communicates with the elongated hole in the lower end of the bracket. The set screw is threaded and corresponds with the adjustment hole. The roller is rotatably connected to the rear surface of the bracket in the upper end and mounted on the track. The fastening device is connected to the bracket and the frameless sliding glass door through the elongated hole and the corresponding through hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
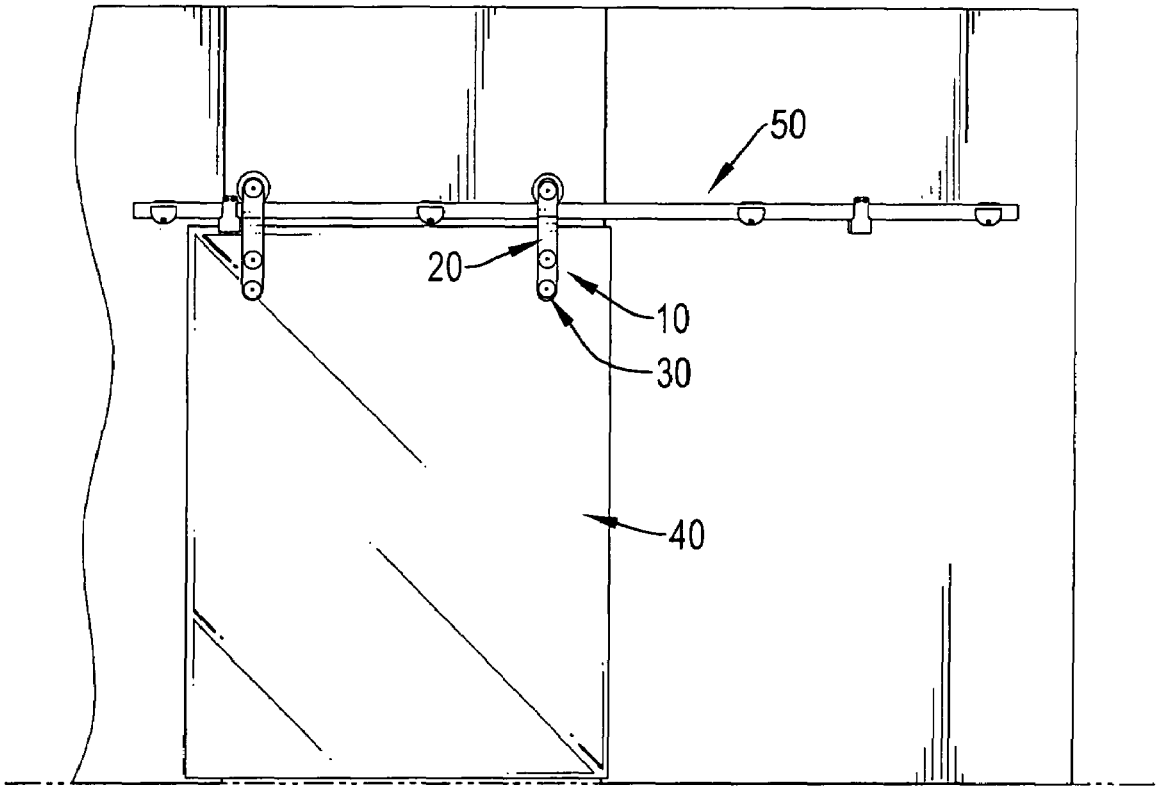
FIG. 1 is a front view of a roller assembly in accordance with the present invention mounted on a frameless sliding glass door.
Figure 2:
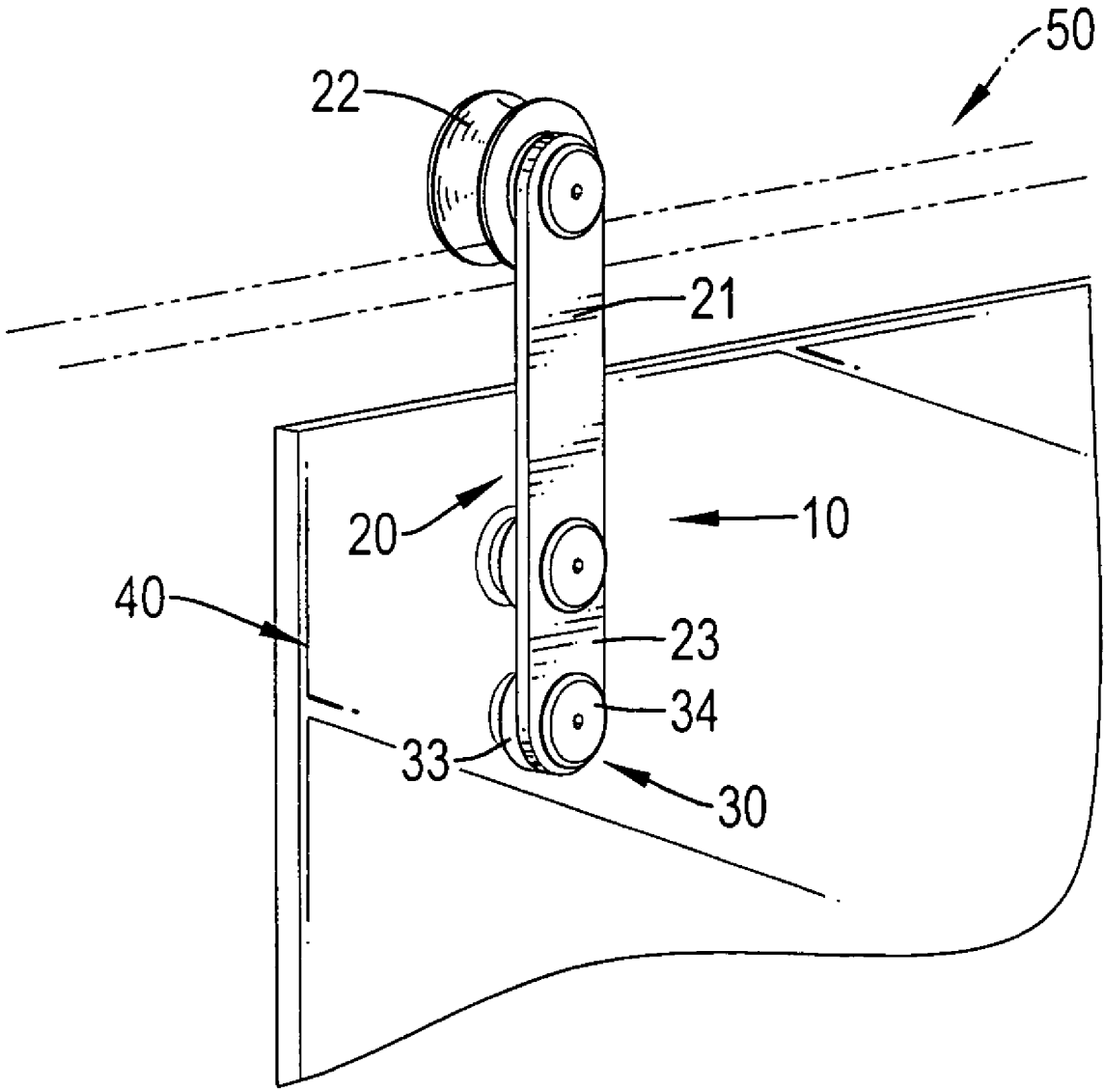
FIG. 2 is an enlarged perspective view of the roller assembly in FIG. 1.
Figure 3:
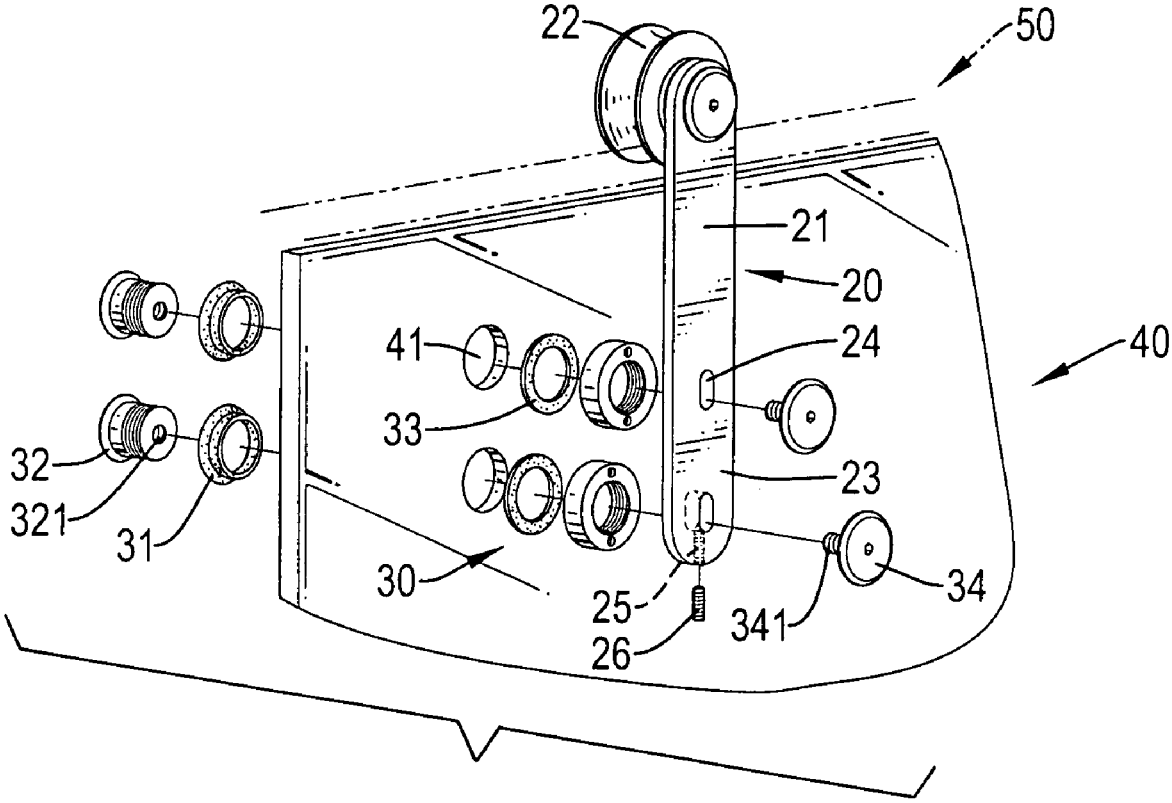
FIG. 3 is an exploded perspective view of the roller assembly in FIG. 2.

With reference to FIGS. 1 to 3, a roller assembly (10) in accordance with the present invention is connected to a frameless sliding glass door (40), to a track (50) and comprises a bracket (20), a roller (22) and at least one fastening device (30).

The frameless sliding glass door (40) has at least one through hole (41) and a bottom. The track (50) is mounted on a wall.

The bracket (20) is attached to the frameless sliding glass door (40) and the track (50) and has a rear surface, an upper end (21), a lower end (23), a lower edge, at least one elongated hole (24), an adjustment hole (25) and a set screw (26). At least one elongated hole (24) is formed through the bracket (20) in the lower edge and corresponds to the at least one through hole (41) in the frameless sliding glass door (40). The adjustment hole (25) is formed through the lower edge of the bracket (20) and communicates with the elongated hole (24) in the lower end of the bracket (20). The set screw (26) is threaded and corresponds with the adjustment hole (25) in the bracket (20) and has a tip and a face. The tip of the set screw (26) may extend into the elongated hole (24) in the lower end of the bracket (20). The face of the set screw (26) has a keyed surface corresponding to a screwdriver used to turn the set screw (26).

The roller (22) is rotatably connected to the rear surface of the bracket (20) at the upper end (21) of the bracket (20) and is movably mounted on the track (50).

The at least one fastening device (30) is mounted through the bracket (20) and the frameless sliding glass door (40) in the elongated hole (24) and a corresponding through hole (41), and each fastening device (30) may comprise an annular sheath (31), a nut (32), a washer (33) and a bolt (34).

The annular sheath (31) is mounted in the corresponding through hole (41) in the frameless sliding glass door (40). The nut (32) is mounted in the annular sheath (31) and extends out the corresponding through hole (41) and has a rim and a connecting hole (321). The rim abuts the annular sheath (31). The connecting hole (321) is formed axially in the nut (32) and aligns with the corresponding elongated hole (24) in the bracket (20). The washer (33) is mounted around the nut (32) adjacent to the bracket (20). The bolt (34) is connected securely to the nut (32) and has a head and a shaft (341). The head abuts the bracket (20) and is larger than the elongated hole (24) and has a center. The shaft (341) is formed on and protrudes from the center of the head and is threaded and corresponding to the connecting hole (321) through the corresponding elongated hole (24). Therefore, the frameless sliding glass door (40) is slidably connected to the track (50) with the roller assemblies (10).

Figure 4:
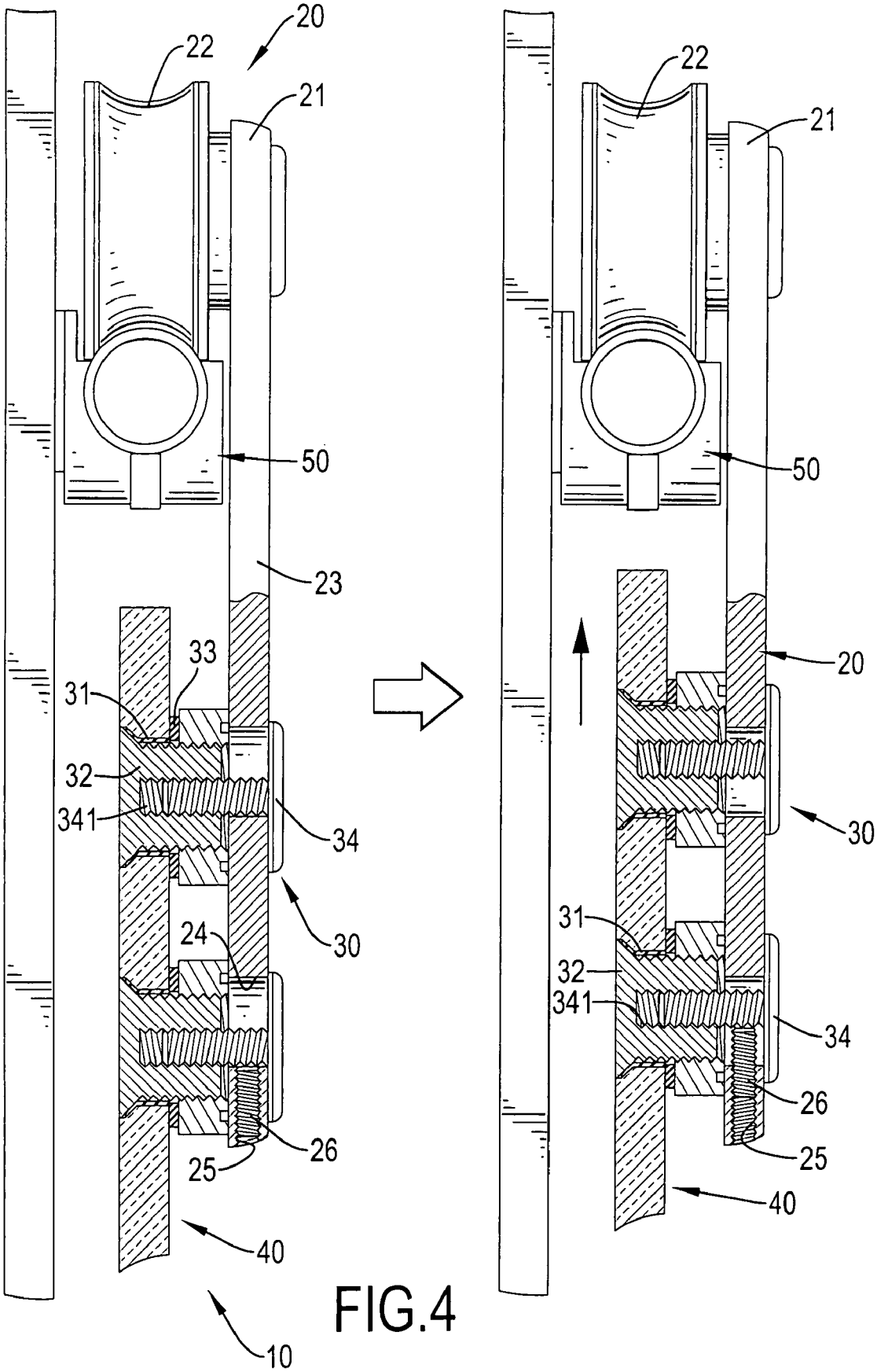
FIG. 4 is an enlarged operational side view in partial section of the roller assembly in FIG. 1.

With further reference to FIG. 4, when the track (50) is mounted at an undesired position on the wall, such as slanting or at an angle from the horizontal, a person can set the bottom of the frameless sliding glass door (40) parallel to the ground by turning the set screw (26) with a screwdriver, causing the tip of the set screw (26) to extend into or out of the corresponding elongated hole (24) and move the corresponding shaft (341) up or down. Therefore, changing the connecting position between the bracket (20) and the frameless sliding glass door (40) and preventing the bottom of the frameless sliding glass door (40) from making contact with the ground.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A roller assembly for use with a frameless sliding glass door comprising a bracket having a rear surface;

an upper end;

a lower end;

a lower edge;

at least one elongated hole being formed through the bracket near the lower end;

an adjustment hole being formed through the lower edge of the bracket, being a threaded hole and communicating with the elongated hole formed through the lower end of the bracket; and a set screw being threaded and screwed into the adjustment hole in the bracket and having a tip extending into the lowest elongated hole; and a face having a keyed surface;

a roller being rotatably connected to the rear surface of the bracket in the upper end; and at least one fastening device being mounted in the at least one elongated hole in the bracket, wherein each at least one fastening device has an annular sheath;

a nut being mounted in the annular sheath and having a rim being mounted in and abutting the annular sheath; and a connecting hole being formed on and protruding axially in the nut, the connecting hole being a threaded hole and being aligned with a corresponding elongated hole in the bracket;

a washer being mounted around the nut adjacent to the bracket; and a bolt being connected securely to the nut and having a head abutting the bracket and being larger than the corresponding elongated hole and having a center; and a shaft being formed on and protruding from the center of the head and being threaded and corresponding to the connecting hole through the corresponding elongated hole, wherein the tip of the set screw abuts against the shaft of the bolt of the fastening device mounted in the lowest elongated hole.

2. A roller assembly for use with a frameless sliding glass door comprising a bracket having a rear surface;

an upper end;

a lower end;

a lower edge;

at least one elongated hole being formed through the bracket near the lower end;

an adjustment hole being formed through the lower edge of the bracket, being a threaded hole and communicating with the elongated hole formed through the lower end of the bracket; and a set screw being threaded and screwed into the adjustment hole in the bracket and having a tip extending into the lowest elongated hole; and a face having a keyed surface a roller being rotatably connected to the rear surface of the bracket in the upper end; and at least one fastening device being mounted in the at least one elongated hole in the bracket, each at least one fastening device comprising a bolt having a head abutting the bracket and being larger than a corresponding elongated hole and having a center; and a shaft being formed on and protruding from the center of the head and mounted through the corresponding elongated hole, wherein the tip of the set screw abuts against the shaft of the bolt of the fastening device mounted in the lowest elongated hole.

* * * * *